US010082813B1

(12) United States Patent
Shinohara

(10) Patent No.: US 10,082,813 B1
(45) Date of Patent: Sep. 25, 2018

(54) CONSTANT VOLTAGE CIRCUIT

(71) Applicants: Kabushiki Kaisha Toshiba, Minato-ku, Tokyo (JP); Toshiba Electronic Devices & Storage Corporation, Minato-ku, Tokyo (JP)

(72) Inventor: Masatoshi Shinohara, Tokyo (JP)

(73) Assignees: Kabushiki Kaisha Toshiba, Minato-ku, Tokyo; Toshiba Electronic Device & Storage Corporation, Minato-ku, Tokyo ( * ) Notice: Subject to any disclaimer, the term of this patent is extended or adjusted under 35 U.S.C. 154(b) by 0 days.

(21) Appl. No.: 15/906,595

(22) Filed: Feb. 27, 2018

(30) Foreign Application Priority Data

Sep. 13, 2017 (JP) ..... 2017-175832

(51) Int. Cl.
*G05F 1/613* (2006.01)

(52) U.S. Cl.
CPC ..... *G05F 1/613* (2013.01)

(58) Field of Classification Search
CPC .. H02M 3/156; H02M 3/158; H02M 3/33507; H02M 1/08; G05F 1/613
See application file for complete search history.

(56) References Cited

U.S. PATENT DOCUMENTS 5,999,041 A * 12/1999 Nagata ..... H03K 17/0822 327/108
6,396,249 B1 * 5/2002 Itakura ..... H03K 17/0822 323/273
8,531,170 B2 * 9/2013 Fukami ..... G05F 1/00 323/313
2017/0288553 A1 * 10/2017 Fahlenkamp ..... H02M 3/33515
2018/0042093 A1 * 2/2018 Hausman, Jr. ..... H05B 37/02

FOREIGN PATENT DOCUMENTS

JP 2002-123324 A 4/2002
JP 3637848 B2 4/2005
JP 2014-126908 A 7/2014

* cited by examiner

*Primary Examiner* — Kyle J Moody
(74) *Attorney, Agent, or Firm* — White & Case LLP

(57) ABSTRACT

According to one embodiment, a constant voltage circuit includes a first resistance including a first terminal coupled to a first voltage terminal, and a second terminal coupled to a first node; a first transistor including a first terminal coupled to the first voltage terminal, a second terminal coupled to a second node, and a control terminal coupled to the first node; a first diode coupled in series between the first node and a second voltage terminal; a Zener diode, and a second transistor coupled in series between the first node and the second voltage terminal; a second resistance, and a third transistor coupled in series between the first node and the second voltage terminal; and third and fourth resistances coupled in series between the second node and the second voltage terminal.

11 Claims, 12 Drawing Sheets

CONSTANT VOLTAGE CIRCUIT

CROSS-REFERENCE TO RELATED APPLICATIONS

This application is based upon and claims the benefit of priority from Japanese Patent Application No. 2017-175832, filed on Sep. 13, 2017, the entire contents of which are incorporated herein by reference.

FIELD

Embodiments described herein relate generally to constant voltage circuit.

BACKGROUND

In a semiconductor device, other than a main power supply circuit, a sub-power supply circuit is provided. The sub-power supply circuit operates when the main power supply circuit is turned off, and power consumption in the sub-power supply circuit is lower than that in the main power supply circuit. As such a sub-power supply circuit, a constant voltage circuit that is simply configured is suggested.

DETAILED DESCRIPTION

Figure 1:
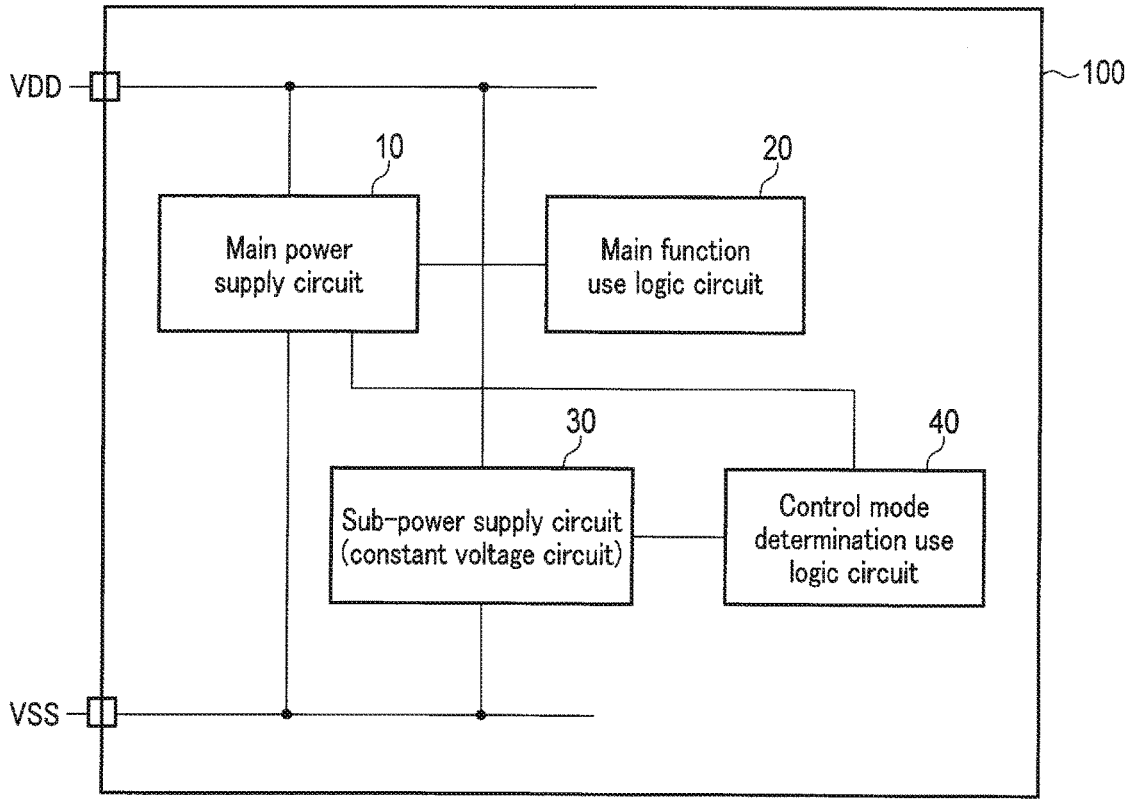
FIG. 1 is a figure showing the configuration of a semiconductor device including the constant voltage circuit according to the first embodiment.

In general, according to one embodiment, a constant voltage circuit includes a first resistance including a first terminal coupled to a first voltage terminal, and a second terminal coupled to a first node, a first transistor of a first conductivity type including a first terminal coupled to the first voltage terminal, a second terminal coupled to a second node, and a control terminal coupled to the first node, a first diode coupled in series between the first node and a second voltage terminal, a Zener diode, and a second transistor of a second conductivity type, which differs from the first conductivity type, coupled in series between the first node and the second voltage terminal, a second resistance, and a third transistor of the first conductivity type coupled in series between the first node and the second voltage terminal, and third and fourth resistances coupled in series between the second node and the second voltage terminal. The control terminal of the second transistor is coupled to a third node to which the first terminal of the second resistance and the first terminal of the third transistor are coupled, and the control terminal of the third transistor is coupled to a fourth node to which the first terminal of the third resistance and the first terminal of the fourth resistance are coupled.

The embodiments will be described below with reference to the drawings. In the drawings, the same portion is indicated by the same reference code.

First Embodiment

The constant voltage circuit according to the first embodiment will be described below with reference to FIGS. 1 to 9. In the following descriptions, "coupling" means not only direct coupling but also coupling via arbitrary elements. The first terminal of a transistor indicates one of a source and a drain, the second terminal of the transistor indicates the other of the source and the drain, and the control terminal of the transistor indicates a gate. If transistors are coupled in series, it means that the first and second terminals are coupled in series. The first terminal of a diode indicates one of a cathode and an anode, and the second terminal of the diode indicates the other of the cathode and the anode.

[Configuration in First Embodiment]

The configuration of a constant voltage circuit 30 in the first embodiment will be described with reference to FIGS. 1 and 2.

FIG. 1 is a figure showing the configuration of a semiconductor device 100 comprising the constant voltage circuit 30 according to the first embodiment.

As shown in FIG. 1, the semiconductor device 100 comprises a main power supply circuit 10, a main function use logic circuit 20, a sub-power supply circuit (constant voltage circuit) 30, and a control mode determination use logic circuit 40.

The main power supply circuit 10 and the sub-power supply circuit 30 are electrically coupled to a power supply voltage terminal. A power supply voltage VDD is externally provided for the power supply voltage terminal. The main power supply circuit 10 and the sub-power supply circuit 30 are electrically coupled to a ground voltage terminal. A ground voltage VSS (e.g., 0V) is externally provided for the ground voltage terminal. The main power supply circuit. 10 and the sub-power supply circuit 30 generate a predetermined voltage, which becomes a power supply for each circuit.

When a control mode is a normal operation mode, the main function use logic circuit 20 performs predetermined operation such as a logical operation. The control mode determination use logic circuit 40 determines a control mode at that time, and controls the control mode. At this time, the main function use logic circuit 20 and the control mode determination use logic circuit 40 operate, using the main power supply circuit 10 as power supply.

Meanwhile, when a control mode is a standby mode, the main function use logic circuit 20 is turned off, and the control mode determination use logic circuit 40 keeps operating. At this time, the control mode determination use logic circuit 40 operates, using the sub-power supply circuit 30 as power supply. The sub-power supply circuit 30 consumes power less than the main power supply circuit 10, but has power sufficient to operate the control mode determination use logic circuit 40. That is, when a control mode is a standby mode, the main power supply circuit 10 whose power consumption is high is turned off, and the sub-power supply circuit 30 whose power consumption is low is used as a power supply. Thereby, the semiconductor device 100 minimizes power consumption necessary at the time of a standby mode.

Figure 2:
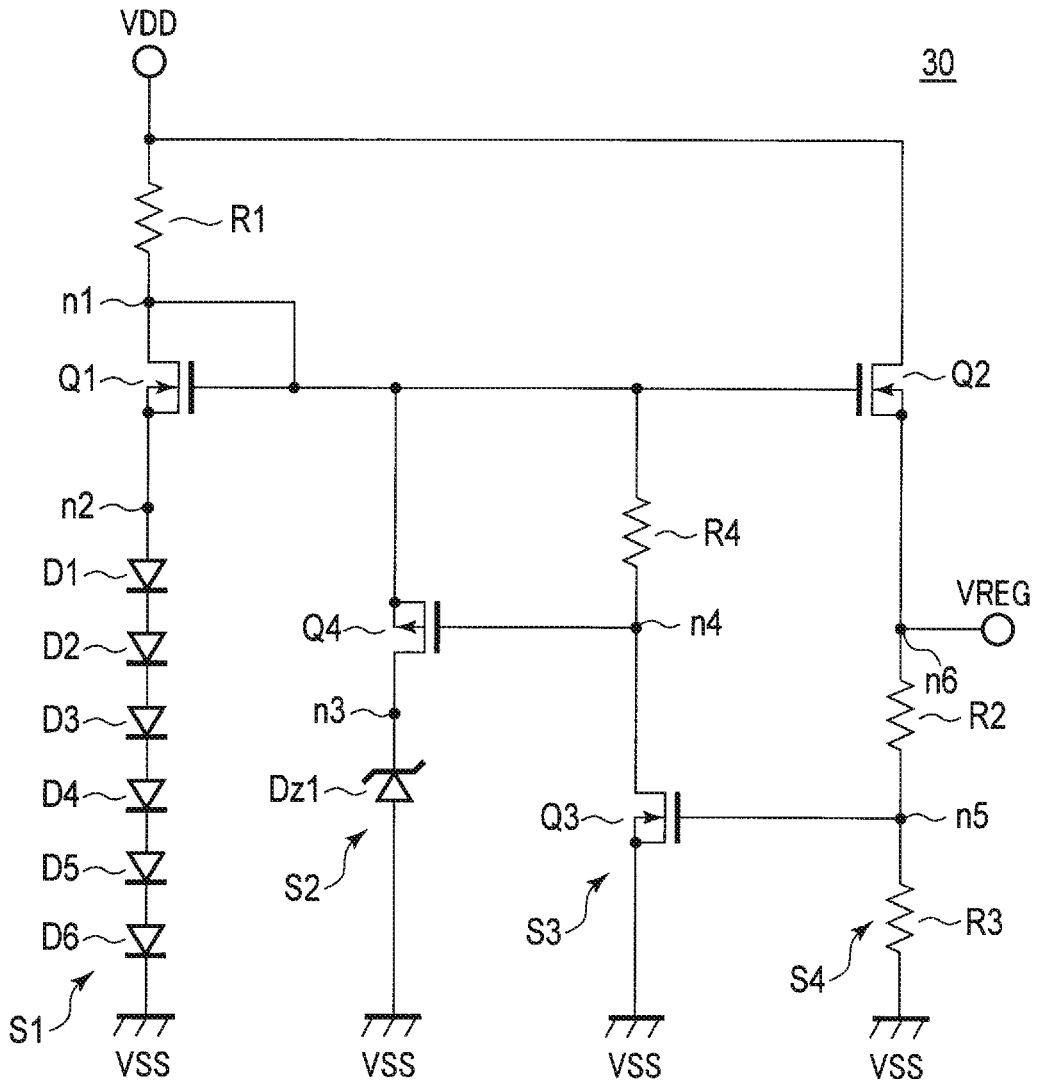
FIG. 2 is a figure showing the configuration of the constant voltage circuit according to the first embodiment.

FIG. 2 is a figure showing the configuration of the constant voltage circuit 30 according to the first embodiment.

As shown in FIG. 2, the constant voltage circuit 30 comprises a resistance R1, an N-type transistor (NMOS transistor) Q1, an N-type transistor Q2, and series circuits S1 to S4.

The resistance R1 comprises first and second terminals. The first terminal of the resistance R1 is electrically coupled to the power supply voltage terminal (first voltage terminal), and the second terminal of the resistance R1 is electrically coupled to a node n1.

The transistor Q1 comprises first and second terminals, and a control terminal. The first terminal and the control terminal of the transistor Q1 are electrically coupled to the node n1. The second terminal of the transistor Q1 is electrically coupled to a node n2.

The transistor Q2 comprises first and second terminals, and a control terminal. The first terminal of the transistor Q2 is electrically coupled to the power supply voltage terminal. The second terminal of the transistor Q2 is electrically coupled to a node n6. The control terminal of the transistor Q2 is electrically coupled to the node n1. The transistor Q2 has the same transistor size, layout, thickness, material, etc., as the transistor Q1. Here, a transistor size is indicated by the gate length and gate width of a transistor. A layout is indicated by a well space, a source and drain diffusion layers, etc. Accordingly, the transistor Q2 comprises the same threshold voltage as the transistor Q1.

The series circuits S1 to S4 are electrically coupled in parallel to one another.

The series circuit S1 is provided between the node n2 and a ground voltage terminal (second voltage terminal), and electrically coupled in series to the resistance R1 and the transistor Q1. The series circuit S1 comprises diodes D1 to D6. The diodes D1 to D6 are electrically coupled in series.

Each of the diodes D1 to D6 comprises first and second terminals (anode and cathode). The anode of the diode D1 is electrically coupled to the node n2, and the cathode of the diode D1 is electrically coupled to the anode of the diode D2. In the same manner, the cathodes of the diodes D2-D5 are electrically coupled to the anodes of the diodes D3-D6, respectively. The cathode of the diode D6 is electrically coupled to the ground voltage terminal.

Note that each of the diodes D1 to D6 may be a PN junction diode, or an NPN transistor. Also, the number of diodes is arbitrary, and can be determined as necessary according to magnitude of output voltage of the constant voltage circuit 30.

The series circuit S2 is provided between the node n1 and a ground voltage terminal, and electrically coupled in series to the resistance R1. The series circuit S2 comprises a P-type transistor (PMOS transistor) Q4, and a Zener diode Dz1. The transistor Q4 and the Zener diode Dz1 are electrically coupled in series.

The transistor Q4 comprises first and second terminals, and a control terminal. The first terminal of the transistor Q4 is electrically coupled to the node n1. The second terminal of the transistor Q4 is electrically coupled to a node n3. The control terminal of the transistor Q4 is electrically coupled to a node n4. The Zener diode Dz1 comprises first and second terminals (anode and cathode). The cathode of the Zener diode Dz1 is electrically coupled to the node n3, and the anode of the Zener diode Dz1 is electrically coupled to the ground voltage terminal.

The series circuit S3 is provided between the node n1 and a ground voltage terminal, and electrically coupled in series to the resistance R1. The series circuit S3 comprises a resistance R4, and an N-type transistor Q3. The resistance R4 and the transistor Q3 are electrically coupled in series.

The resistance R4 comprises first and second terminals. The first terminal of the resistance R4 is electrically coupled to the node n1, and the second terminal of the resistance R4 is electrically coupled to the node n4. The transistor Q3 comprises first and second terminals, and a control terminal. The first terminal of the transistor Q3 is electrically coupled to the node n4. The second terminal of the transistor Q3 is electrically coupled to the ground voltage terminal. The control terminal of the transistor Q3 is electrically coupled to a node n5.

The series circuit S4 is provided between the node n6 and a ground voltage terminal, and electrically coupled in series to the transistor Q2. The series circuit S4 comprises resistances R2 and R3. The resistances R2 and R3 are electrically coupled in series.

The resistance R2 comprises first and second terminals. The first terminal of the resistance R2 is electrically coupled to the node n6, and the second terminal of the resistance R2 is electrically coupled to the node n5. The resistance R3 comprises first and second terminals. The first terminal of the resistance R3 is electrically coupled to the node n5, and the second terminal of the resistance R3 is electrically coupled to the ground voltage terminal.

The constant voltage circuit 30 outputs a voltage VREG via the node n6.

[Operation in First Embodiment]

The operation of the constant voltage circuit 30 in the first embodiment will be described with reference to FIGS. 3 and 4.

Figure 3:
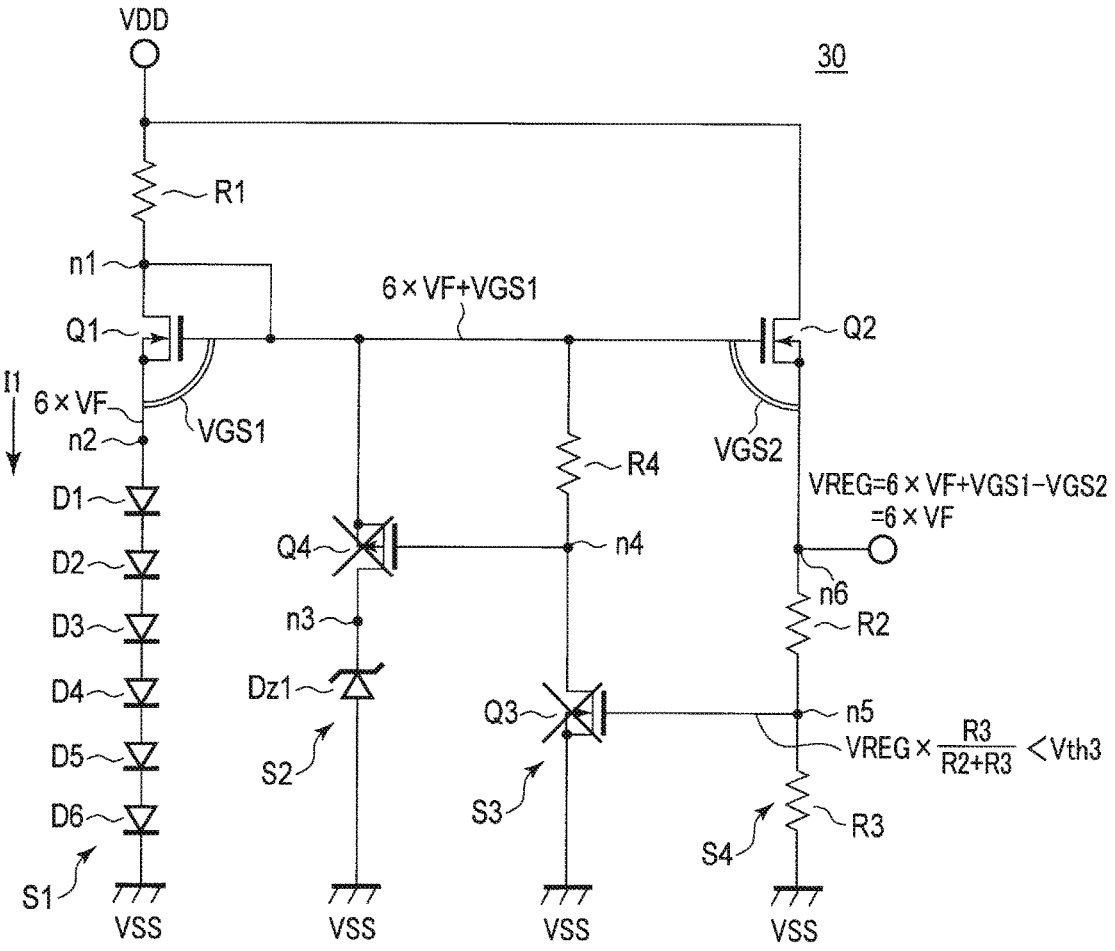
FIG. 3 is a figure showing the operation of the constant voltage circuit according to the first embodiment.
Figure 4:
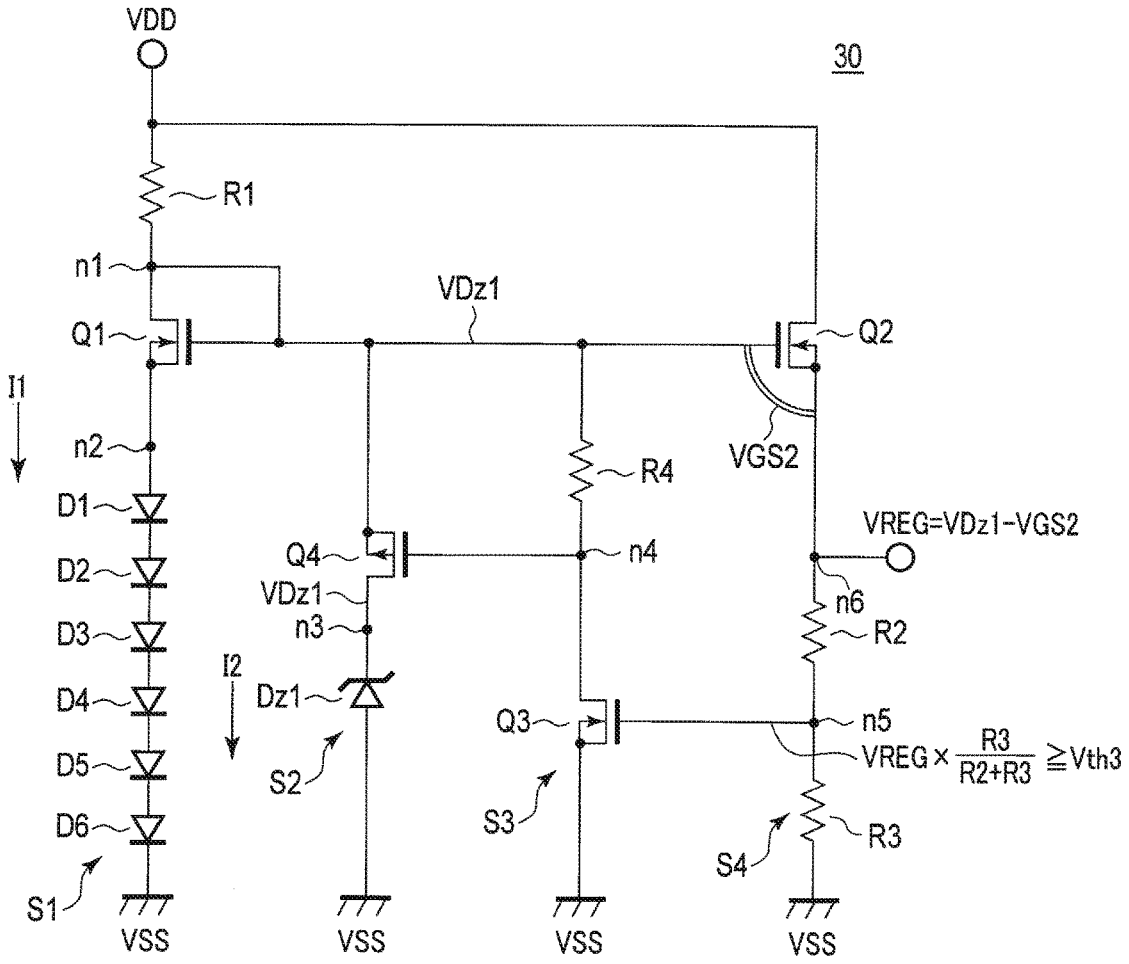
FIG. 4 is a figure showing the operation of the constant voltage circuit according to the first embodiment.

FIGS. 3 and 4 are figures showing the operation of the constant voltage circuit 30 according to the first embodiment. More specifically, FIG. 3 is a figure showing the operation when an output voltage VREG is lower than a predetermined voltage, and FIG. 4 is a figure showing the operation when an output voltage VREG is equal to or higher than a predetermined voltage.

Generally, the output voltage of a constant voltage circuit depends on temperature, and has negative temperature characteristics (negative temperature coefficient). That is, the higher a temperature is, the lower an output voltage of a constant voltage circuit becomes. In the constant voltage circuit 30 in the first embodiment, when an output voltage VREG gets lower than a predetermined voltage at the time of high temperature, the output voltage VREG is set based on dropped voltages of the diodes D1 to D6. When an output voltage gets equal to or higher than a predetermined voltage at the time of low temperature, a voltage based on the dropped voltages of the diodes D1 to D6 is clamped by the Zener diode Dz1. As a result, the output voltage VREG is set based on a dropped voltage of the Zener diode Dz1. Such switching is performed by electrically cutting off the Zener diode Dz1 from the constant voltage circuit 30 according to the value of a voltage VREG. The operation of the constant voltage circuit 30 in the first embodiment will be detailed below.

Note that in the descriptions given below, the resistance values of the resistances R1 to R4 are determined to be R1 to R4, respectively. Also, each of the diodes D1 to D6 drops a voltage by a voltage VF, and the Zener diode Dz1 drops a voltage by a voltage VDz1.

As shown in FIGS. 3 and 4, an output voltage VREG is divided by the resistances R2 and R3, and applied to the node n5. Thereby, a voltage [VREG×{R3/(R2−R3)}] is applied to the node n5.

As shown in FIG. 3, when a voltage [VREG×{R3/(R2+R3)}] lower than a threshold voltage Vth3 of the transistor Q3, that is, when an output voltage VREG is lower than a predetermined voltage at the time of high temperature, the transistor Q3 is turned off. As a result, the transistor Q4 is turned off, and the Zener diode Dz1 is electrically cut off from the constant voltage circuit 30. In this case, as described below, an output voltage VREG is set based on a voltage generated by the diodes D1 to D6.

Firstly, a voltage VDD dropped via the resistance R1 is applied to the gate of the transistor Q1, whereby the transistor Q1 is turned on. Thereby, a current I1 flows through the diodes D1 to D6. The current I1 is a current by which each of the diodes D1 to D6 can stably generate a voltage VF. As a result, a voltage [6×VF] is applied to the node n2 (the source of the transistor Q1) by the diodes D1 to D6. Accordingly, a voltage [6×VF+VGS1] is applied to the gate of the transistor Q1 (VGS1 is a voltage between the gate and the source of the transistor Q1). This voltage [6×VF+VGS1] is also applied to the gate of the transistor Q2. Because of this, a voltage [6×VF+VGS1−VGS2] is applied to the node n6 (the source of the transistor Q2) (VGS2 is a voltage between the gate and the source of the transistor Q2). Here, a voltage VGS1 (a threshold voltage of the transistor Q1) and a voltage VGS2 (a threshold voltage of the transistor Q2) are equal. Accordingly, a voltage [6×VF] is applied to the node n6, and the voltage [6×VF] is output as a voltage VREG.

Meanwhile, as shown in FIG. 4, when a voltage [VREG×{R3/(R2+R3)}] is equal to or higher than a threshold voltage Vth3 of the transistor Q3, that is, when an output voltage VREG is equal to or higher than a predetermined voltage at the time of low temperature, the transistor Q3 is turned on. As a result, a ground voltage VSS is applied to the gate of the transistor Q4, and the transistor Q4 is turned on. Accordingly, the Zener diode Dz1 is electrically coupled to the constant voltage circuit 30. Thereby, as described below, an output voltage VREG is set based on a voltage generated by the Zener diode Dz1.

Firstly, a voltage VDD dropped via the resistance R1 is applied to the gate of the transistor Q1, whereby the transistor Q1 is turned on. Thereby, a current I2 flows through the Zener diode Dz1. The current I2 is a current by which the Zener diode Dz1 can stably generate a voltage VDz1. Meanwhile, a current I1 flows through the diodes D1 to D6.

Here, the Zener diode Dz1 has a device characteristic by which a dropped voltage does not become equal to or higher than a voltage VDz1, and is fixed by the voltage VDz1. Accordingly, the Zener diode Dz1 clamps a voltage of the node n1 (the gate of the transistor Q1) so as not to be equal to or higher than a voltage VDz1. Voltages [6×VF] of the diodes D1 to D6 have negative temperature characteristics. The lower a temperature is, the higher the voltages become. Because of this, when a voltage [6×VF+VGS1] gets equal to or higher than a voltage VDz1 at the time of low temperature, a voltage of the gate of the transistor Q1 is clamped to be a voltage VDz1. This voltage VDz1 is also applied to the gate of the transistor Q2. Because of this, a voltage [VDz1−VGS2] is applied to the node n6 (the source of the transistor Q2). Accordingly, the voltage [VDz1−VGS2] is output as a voltage VREG.

[Advantageous Effect in First Embodiment]

Figure 5:
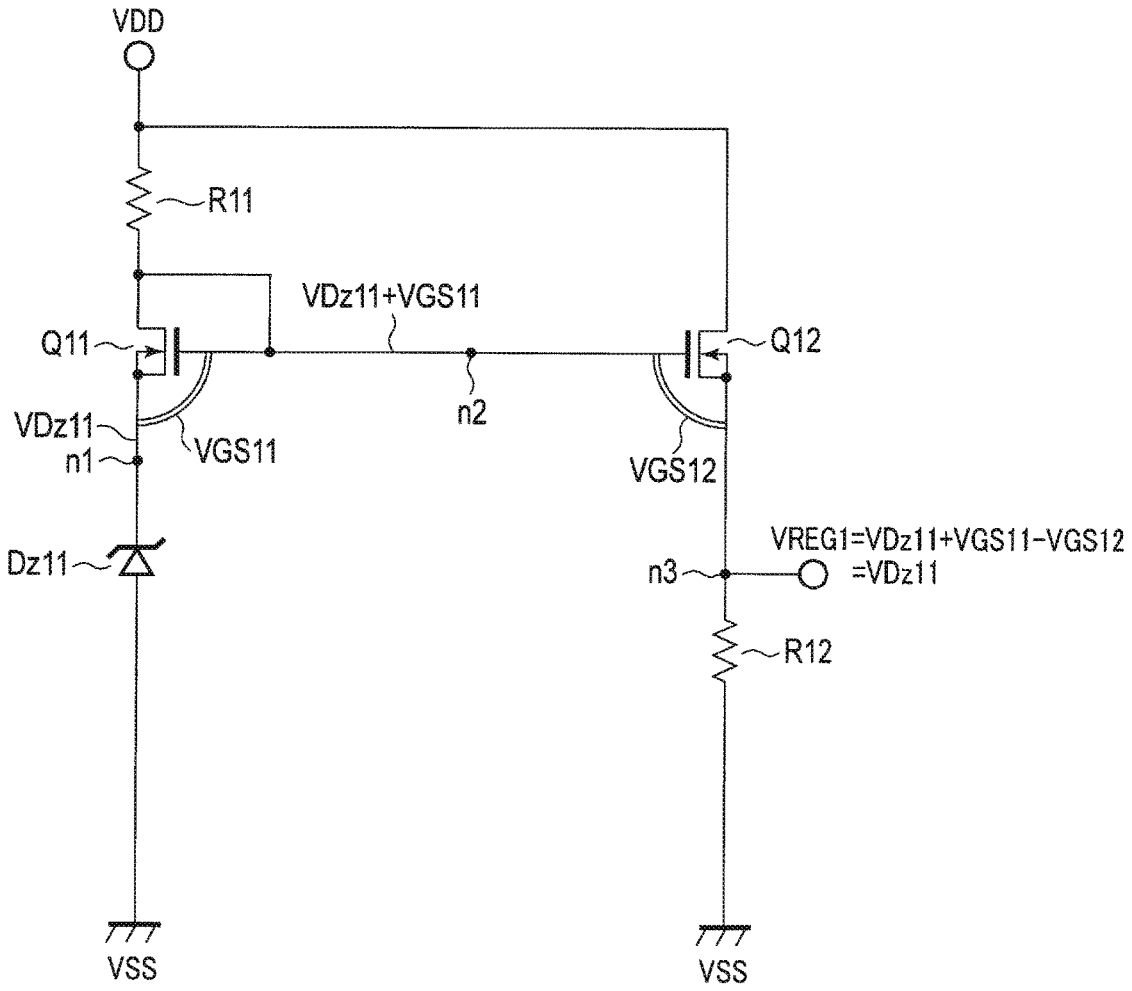
FIG. 5 is a figure showing the configuration of the constant voltage circuit according to comparison example 1.
Figure 6:
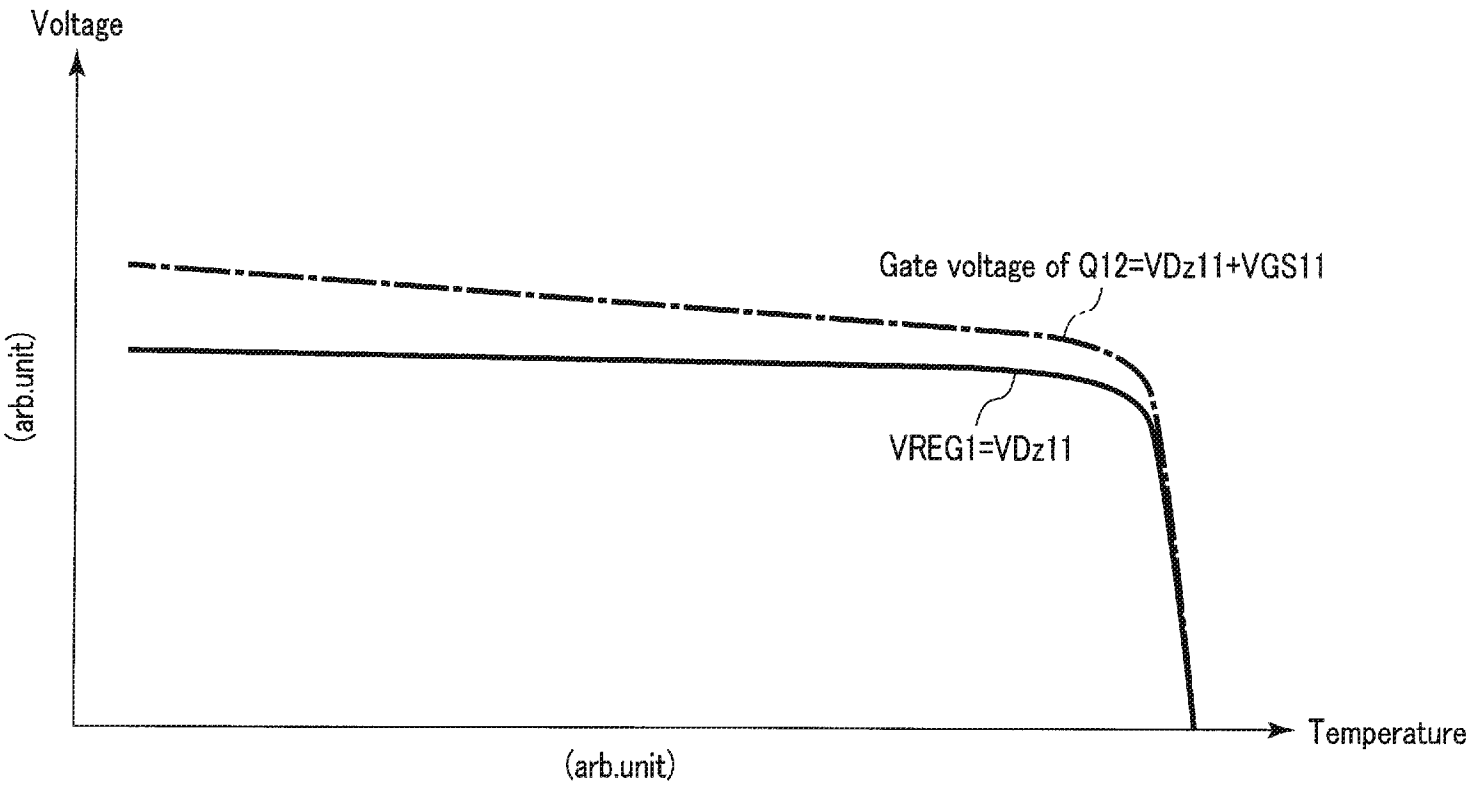
FIG. 6 is a figure showing the relationship between output voltage of the constant voltage circuit according to comparison example 1 and temperature.

FIG. 5 is a figure showing the configuration of the constant voltage circuit according to comparison example 1. FIG. 6 is a figure showing the relationship between an output voltage VREG 1 of the constant voltage circuit 30 according to comparison example 1 and temperature.

As shown in FIG. 5, the constant voltage circuit in comparison example 1 comprises resistances R11 and R12, transistors Q11 and Q12, and a Zener diode Dz11. Here, the Zener diode Dz11 drops a voltage by a voltage VDz11. Also, a voltage VGS11 is determined to be a voltage between the gate and the source of the transistor Q11, a voltage VGS12 is determined to be a voltage between the gate and the source of the transistor Q12. In addition, a threshold voltage of the transistor Q11 and that of the transistor Q12 are determined to be the same. In this case, in the constant voltage circuit in comparison example 1, an output voltage VREG1 is set based on a dropped voltage VDz11 of the Zener diode Dz11. More specifically, a voltage VDz11 is applied to a node n1, and a voltage [VDz11+VGS11] is applied to a node n2 (the gate of the transistor Q12). Accordingly, a voltage [VDz11+VGS11−VGS12], that is, a voltage VDz11, is applied to a node n3 (the source of the transistor Q12), and the voltage VDz11 is output as a voltage VREG1.

However, in the Zener diode Dz11, the amount of leak current gets large at the time of high temperature. As a result, as shown in FIG. 6, a gate voltage of the transistor Q12 of the constant voltage circuit in comparison example 1 and an output voltage VREG1 (VDz11) based on this gate voltage plummet at the time of high temperature. Because of this, the constant voltage circuit in comparison example 1 does not normally operate at the time of high temperature.

Figure 7:
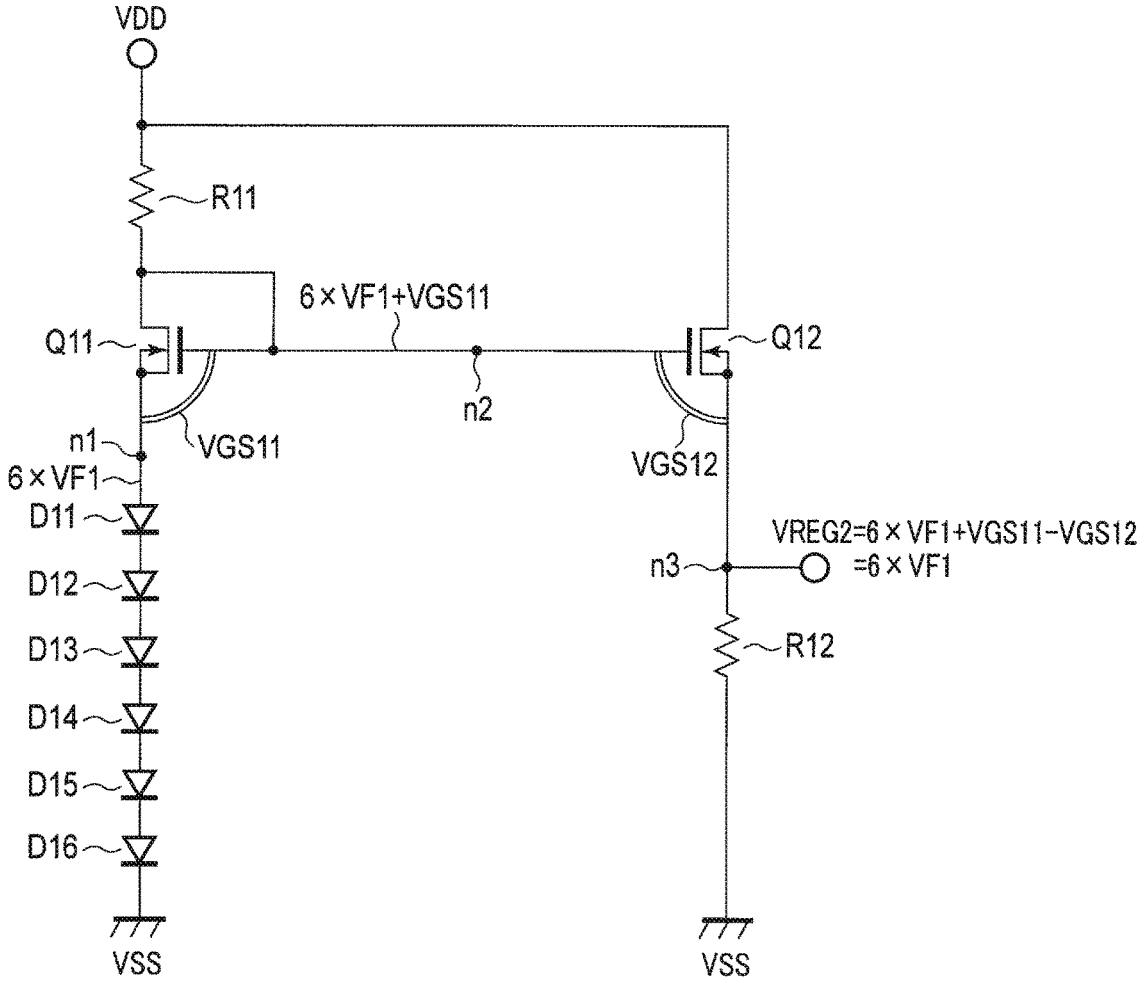
FIG. 7 is a figure showing the configuration of the constant voltage circuit according to comparison example 2.
Figure 8:
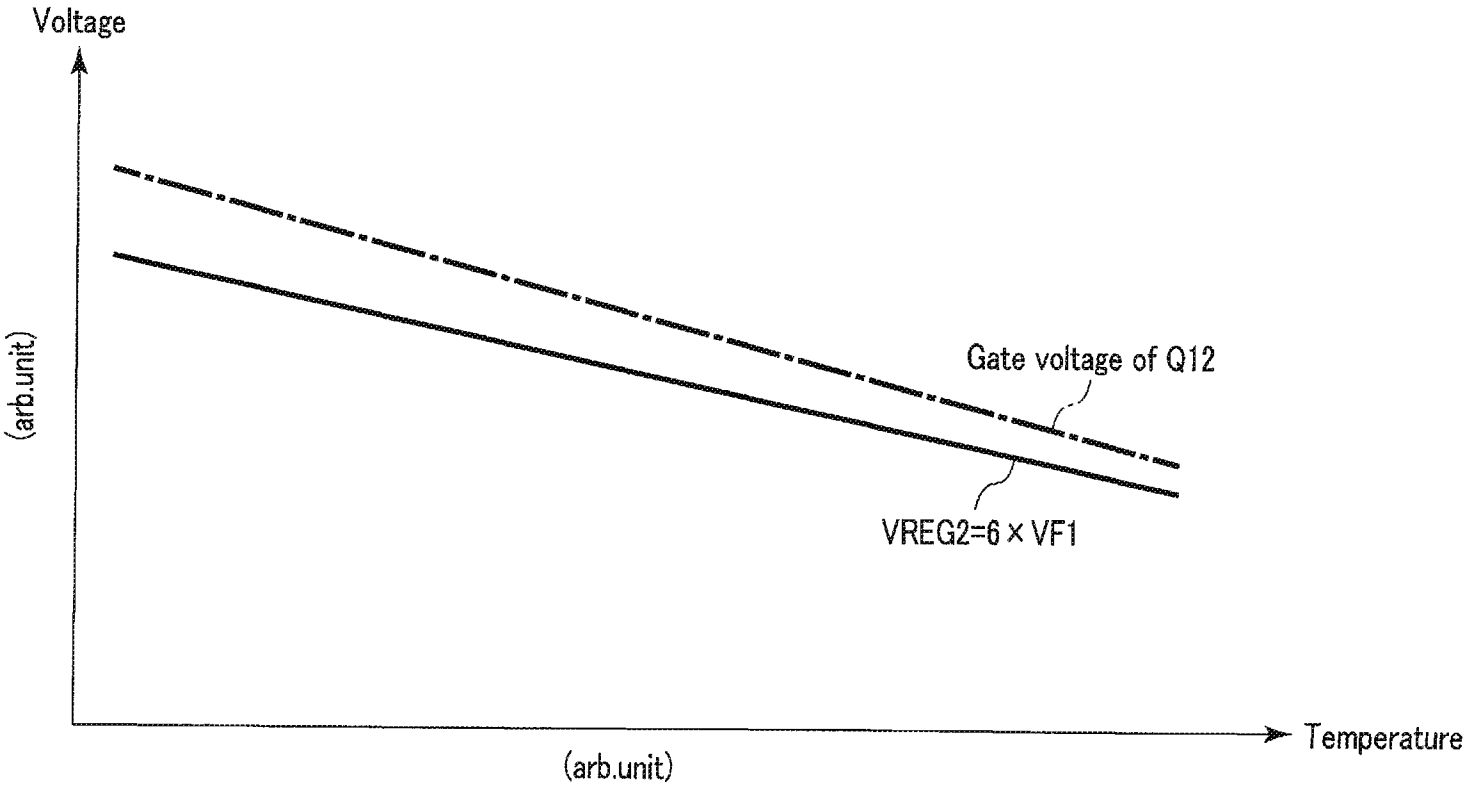
FIG. 8 is a figure showing the relationship between output voltage of the constant voltage circuit according to comparison example 2 and temperature.

FIG. 7 is a figure showing the configuration of the constant voltage circuit according to comparison example 2. FIG. 8 is a figure showing the relationship between an output voltage VREG2 of the constant voltage circuit 30 according to comparison example 2 and temperature.

As shown in FIG. 7, the constant voltage circuit in comparison example 2 comprises diodes D11 to D16 instead of the Zener diode Dz11 of comparison example 1. Here, each of the diodes D11 to D16 drops a voltage by a voltage VF1. In this case, in the constant voltage circuit in comparison example 2, an output voltage VREG2 is set based on dropped voltages of the diodes D11 to D16. More specifically, a voltage [6×VF1] is applied to the node n1, and a voltage [6×VF1+VGS11] is applied to the node n2 (the gate of the transistor Q12). Accordingly, a voltage [δ×VF1+VGS11−VGS12], that is, a voltage [6×VF1], is applied to the node n3, and the voltage [6×VF1] is output as a voltage VREG2.

In the diodes D11 to D16, sudden current leakage at the time of high temperature as in the Zener diode Dz11 of comparison example 1 does not occur. Because of this, the constant voltage circuit in comparison example 2 can normally operate even at the time of high temperature. However, the diodes D11 to D16 have temperature dependency higher than the Zener diode Dz11. Accordingly, as shown in FIG. 8, a gate voltage of the transistor Q12 of the constant voltage circuit in comparison example 2 and an output voltage VREG2 (6×VF1) based on this gate voltage have negative temperature characteristics (negative temperature coefficient) larger than those in comparison example 1. Because of this, variation in an output voltage VREG2 (6×VF1) along with temperature change gets wider than that in comparison example 1. This causes concern that specifications of a logic circuit, etc., using the constant voltage circuit according to comparison example 2 as a power supply are not satisfied. For example, if an output voltage VREG2 at the time of high temperature is set to an amount necessary for a logic circuit, etc., the output voltage VREG2 at the time of low temperature gets higher than necessary. This causes concern that as a result, an overvoltage is applied to the logic circuit, etc., at the time of low temperature, which leads to element destruction in the logic circuit, etc.

Figure 9:
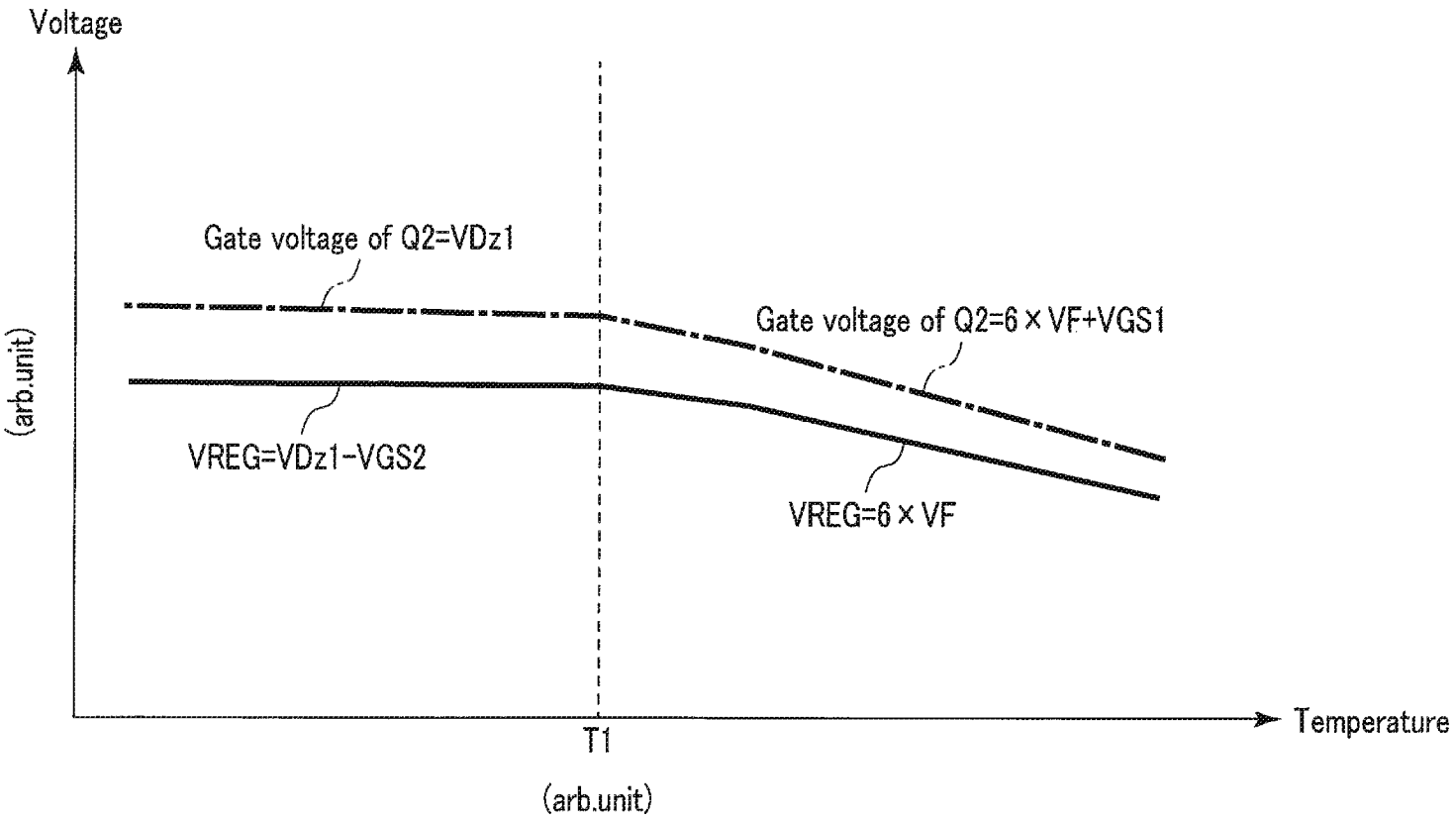
FIG. 9 is a figure showing the relationship between output voltage of the constant voltage circuit according to the first embodiment and temperature.

FIG. 9 is a figure showing the relationship between an output voltage VREG of the constant voltage circuit 30 according to the first embodiment and temperature.

To solve the above problems, in the first embodiment, the constant voltage circuit 30 comprises the Zener diode Dz1, and the diodes D1 to D6. The constant voltage circuit 30, when an output voltage VREG is lower than a predetermined voltage at the time of high temperature, generates the output voltage VREG on the basis of dropped voltages [6×VF] of the diodes D1 to D6. Meanwhile, in the constant voltage circuit 30, when the output voltage VREG gets equal to or higher than a predetermined voltage at the time of low temperature, a voltage based on the dropped voltages [6×VF] of the diodes D1 to D6 is clamped by the Zener diode Dz1. As a result, the output voltage VREG is generated based on a dropped voltage VDz1 of the Zener diode Dz1.

More specifically, as shown in FIG. 9, when a temperature is higher than a temperature T1, the Zener diode Dz1 is electrically cut off from the constant voltage circuit 30 (the transistors Q3 and Q4 are turned off). Alternatively, even if the Zener diode Dz1 is electrically coupled to the constant voltage circuit 30 (even if the transistors Q3 and Q4 are turned on), a gate voltage of the transistor Q2 is equal to or lower than a dropped voltage VDz1 of the Zener diode Dz1. In this case, the constant voltage circuit 30 sets an output voltage VREG on the basis of dropped voltages [6×VF] of the diodes D1 to D6. That is, as shown in FIG. 3, a voltage [6×VF+VGS1] is applied to the gate of the transistor Q2, and a voltage [6×VF] is output as a voltage VREG.

Meanwhile, as shown in FIG. 9, when a temperature is equal to or lower than the temperature T1, the Zener diode Dz1 is electrically coupled to the constant voltage circuit 30 (the transistors Q3 and Q4 are turned on). In this case, when a gate voltage of the transistor Q2 is higher than a dropped voltage VDz1 of the Zener diode Dz1, the gate voltage of the transistor Q2 is clamped by the Zener diode Dz1. In this case, the constant voltage circuit 30 sets an output voltage VREG on the basis of a dropped voltage VDz1 of the Zener diode Dz1. That is, as shown in FIG. 4, a voltage [VDz1] is applied to the gate of the transistor Q2, and a voltage [VDz1−VGS2] is output as a voltage VREG.

By the above-described operation; at the time of high temperature, an output voltage VREG is set by the diodes D1 to D6 whose voltages do not plummet, and at the time of low temperature, an output voltage VREG is set by the Zener diode Dz1 whose temperature characteristics are relatively small. This makes it possible to reduce variation in an output voltage VREG between the time of high temperature and the time of low temperature, and solve the problem at the time of high temperature shown in comparison example 1, and the problem at the time of low temperature shown in comparison example 2. That is, it is possible at the time of high temperature to prevent the influence of the temperature characteristics of the Zener diode Dz1, and inhibit a sudden decrease in output voltage. It is also possible at the time of low temperature to prevent the influence of the temperature characteristics of the diodes D1 to D6, and inhibit application of overvoltage to a logic circuit, etc.

Note that the transistor Q1 does not need to be provided in the first embodiment. In this case, the node n1 and the node n2 are the same node. The constant voltage circuit 30, at the time of high temperature, outputs a voltage [6×VF−VGS2] as an output voltage VREG, and at the time of low temperature, outputs a voltage [VDz1−VGS2] as an output voltage VREG.

Second Embodiment

The constant voltage circuit according to the second embodiment will be described below with reference to FIGS. 10 to 12.

In the above first embodiment, a dropped voltage VDz1 of the Zener diode Dz1 is provided for the node n1 (the gate of the transistor Q1). In contrast, in the second embodiment, a dropped voltage VDz1 of the Zener diode Dz1 is provided for the node n2 (the source of the transistor Q1). The second embodiment will be detailed below.

Note that in the second embodiment, descriptions of the same points as the above first embodiment will be omitted, and mainly different points will be described.

[Configuration in Second Embodiment]

The configuration of a constant voltage circuit 30 in the second embodiment will be described with reference to FIG. 10.

Figure 10:
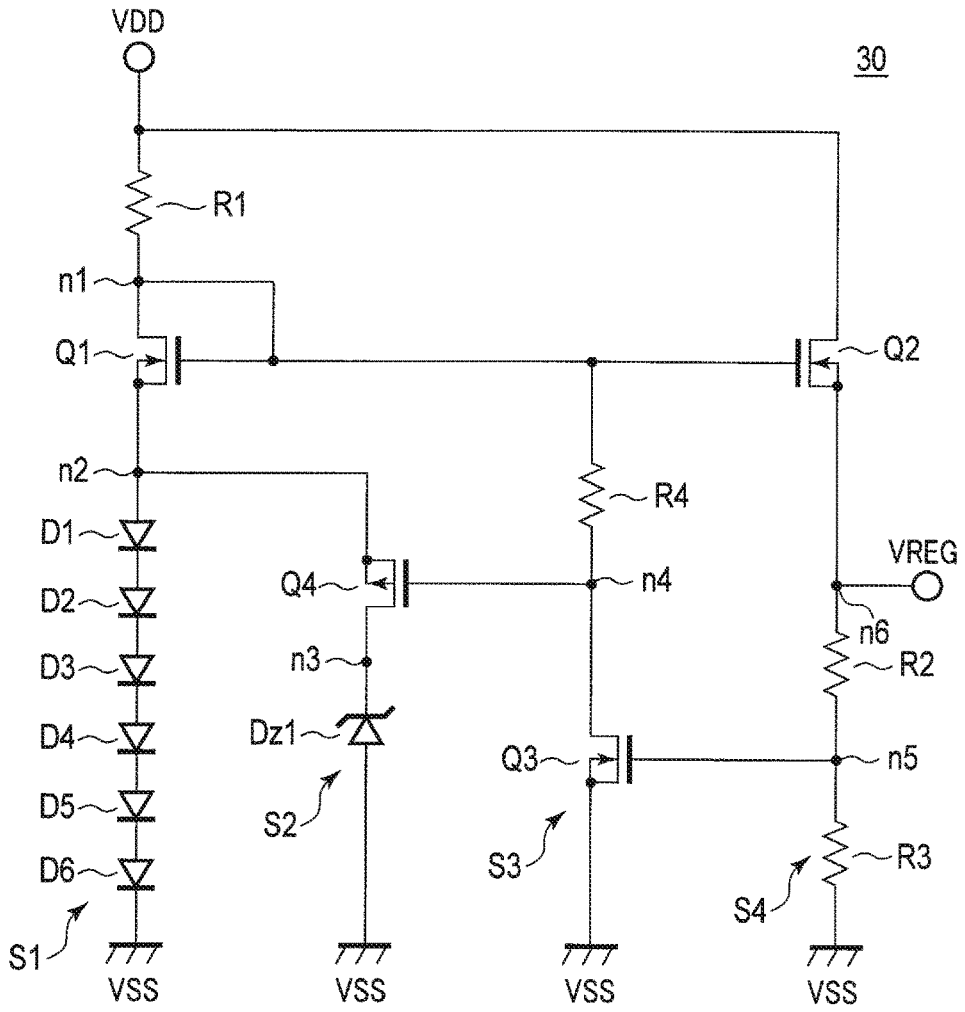
FIG. 10 is a figure showing the configuration of the constant voltage circuit according to the second embodiment.

FIG. 10 is a figure showing the configuration of the constant voltage circuit 30 according to the second embodiment.

As shown in FIG. 10, the constant voltage circuit 30 comprises a resistance R1, an N-type transistor (NMOS transistor) Q1, an N-type transistor Q2, and series circuits S1 to S4.

In the second embodiment, being different from the above first embodiment, the series circuit S2 is provided between a node n2 and a ground voltage terminal. That is, the first terminal of a transistor Q4 is electrically coupled to the node n2 (the source of the transistor Q1).

[Operation in Second Embodiment]

The operation of the constant voltage circuit 30 in the second embodiment will be described with reference to FIGS. 11 and 12.

Figure 11:
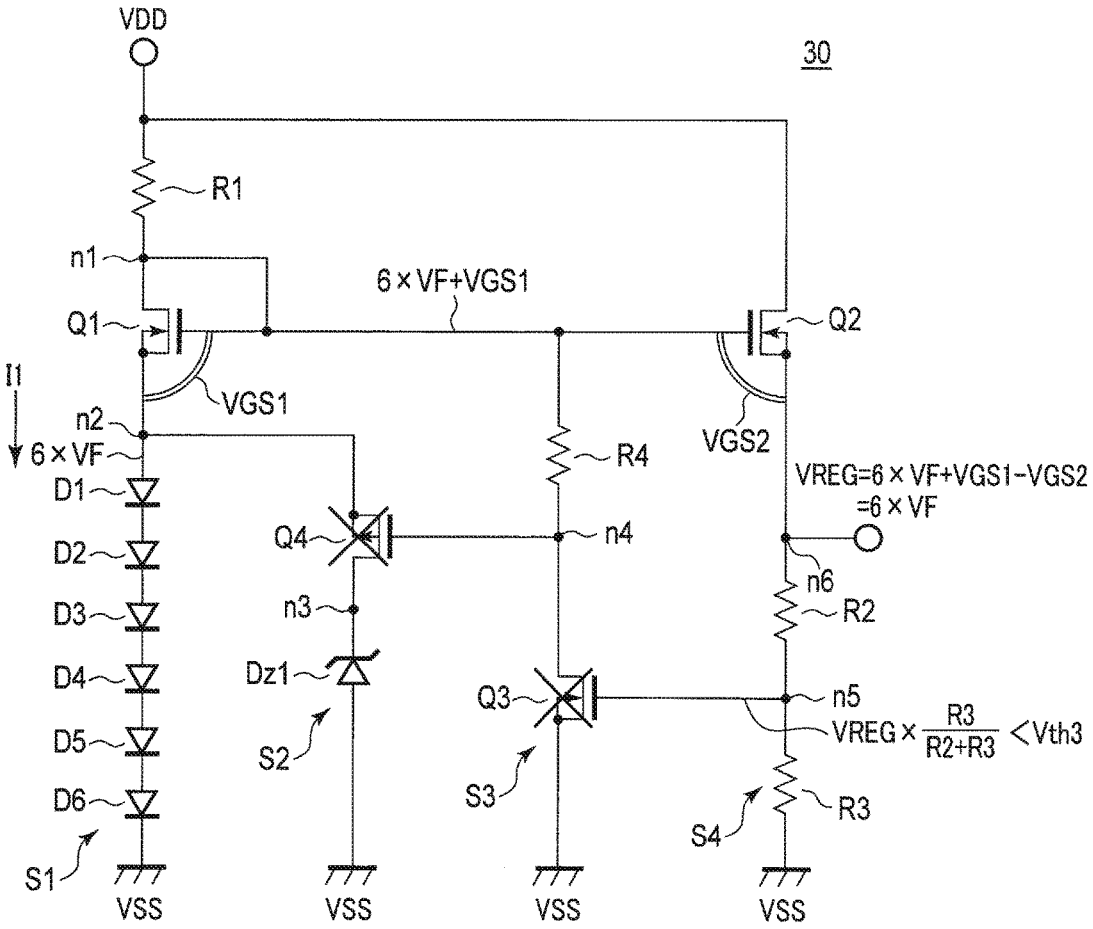
FIG. 11 is a figure showing the operation of the constant voltage circuit according to the second embodiment.
Figure 12:
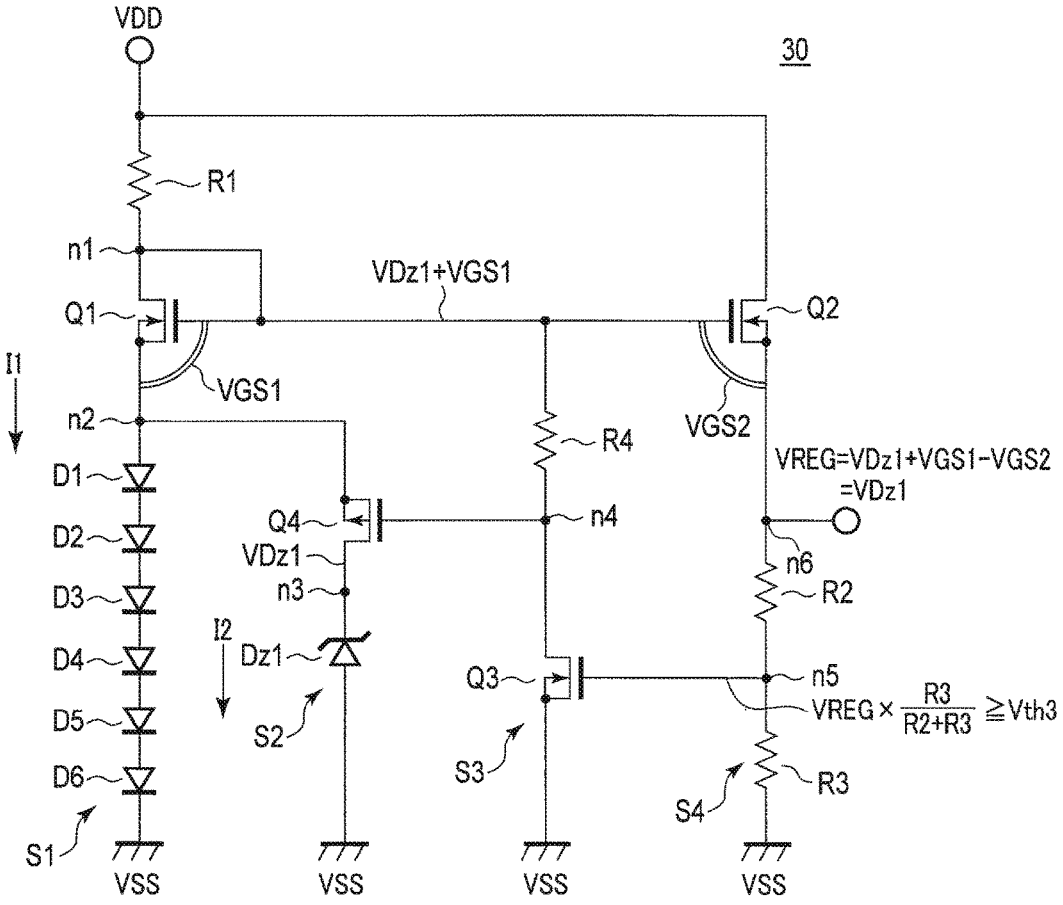
FIG. 12 is a figure showing the operation of the constant voltage circuit according to the second embodiment.

FIGS. 11 and 12 are figures showing the operation of the constant voltage circuit 30 according to the second embodiment. More specifically, FIG. 11 is a figure showing the operation when an output voltage VREG is lower than a predetermined voltage, and FIG. 12 is a figure showing the operation when an output voltage VREG is equal to or higher than a predetermined voltage.

As shown in FIGS. 11 and 12, an output voltage VREG is divided by resistances R2 and R3, and applied to a node n5. Thereby, a voltage [VREG×{R3/(R2+R3)}] is applied to the node n5.

As shown in FIG. 11, when a voltage [VREG×{R3/(R2+R3)}] is lower than a threshold voltage Vth3 of a transistor Q3, that is, when an output voltage VREG is lower than a predetermined voltage at the time of high temperature, the transistor Q3 is turned off. As a result, the transistor Q4 is turned off, and a Zener diode Dz1 is electrically cut off from the constant voltage circuit 30. In this case, as in the first embodiment, a voltage [6×VF] is applied to a node n6, and the voltage [6×VF] is output as a voltage VREG.

Meanwhile, as shown in FIG. 12, when a voltage [VREG×{R3/(R2+R3)}] is equal to or higher than a threshold voltage Vth3 of the transistor Q3, that is, when an output voltage VREG is equal to or higher than a predetermined voltage at the time of low temperature, the transistors Q3 and Q4 are turned on. As a result, the Zener diode Dz1 is electrically coupled to the constant voltage circuit 30, and the output voltage VREG is set based on a voltage generated by the Zener diode Dz1, as described below.

Firstly, a voltage VDD dropped via the resistance R1 is applied to the gate of the transistor Q1, whereby the transistor Q1 is turned on. Thereby, a current I2 flows through the Zener diode Dz1. The current I2 is a current by which the Zener diode Dz1 can stably generate a voltage VDz1. Meanwhile, a current I1 flows through diodes D1 to D6.

Here, the Zener diode Dz1 has a device characteristic by which a dropped voltage does not become equal to or higher than a voltage VDz1, and is fixed by the voltage VDz1. Accordingly, the Zener diode Dz1 clamps a voltage of the node n2 (the source of the transistor Q1) so as not to be equal to or higher than a voltage VDz1. Voltages [6×VF] of the diodes D1 to D6 have negative temperature characteristics. The lower a temperature is, the higher the voltages become. Because of this, when a voltage [6×VF] is equal to or higher than a voltage VDz1 at the time of low temperature, a voltage of the source of the transistor Q1 is clamped to be a voltage VDz1. Accordingly, a voltage [VDz1+VGS1] is applied to the gate of the transistor Q1. This voltage [VDz1+VGS1] is also applied to the gate of the transistor Q2. Because of this, a voltage [VDz1+VGS1−VGS2] is applied to the node n6 (the source of the transistor Q2). Accordingly, a voltage VDz1 is applied to the node n6, and the voltage VDz1 is output as a voltage VREG.

[Advantageous Effect in Second Embodiment]

In the second embodiment, in the constant voltage circuit 30, when an output voltage VREG gets equal to or higher than a predetermined voltage at the time of low temperature, dropped voltages [6×VF] of the diodes D1 to D6 are clamped by the Zener diode Dz1. As a result, the output voltage VREG is generated based on a dropped voltage VDz1 of the Zener diode Dz1. That is, as shown in FIG. 12, a voltage [VDz1+VGS1] is applied to the gate of the transistor Q2, and a voltage [VDz1] is output as a voltage VREG. Thereby, advantageous effect similar to the first embodiment can be obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A constant voltage circuit comprising:

a first resistance including a first terminal coupled to a first voltage terminal, and a second terminal coupled to a first node;

a first transistor of a first conductivity type including a first terminal coupled to the first voltage terminal, a second terminal coupled to a second node, and a control terminal coupled to the first node;

a first diode coupled in series between the first node and a second voltage terminal;

a Zener diode, and a second transistor of a second conductivity type, which differs from the first conductivity type, coupled in series between the first node and the second voltage terminal;

a second resistance, and a third transistor of the first conductivity type coupled in series between the first node and the second voltage terminal; and third and fourth resistances coupled in series between the second node and the second voltage terminal, wherein a control terminal of the second transistor is coupled to a third node to which a first terminal of the second resistance and a first terminal of the third transistor are coupled, and a control terminal of the third transistor is coupled to a fourth node to which a first terminal of the third resistance and a first terminal of the fourth resistance are coupled.

2. The circuit of claim 1, further comprising:

a fourth transistor of the first conductivity type including a first terminal and a control terminal coupled to the first node, and a second terminal coupled to a fifth node, wherein the first diode is coupled in series between the fifth node and the second voltage terminal.

3. The circuit of claim 1, further comprising:

a fourth transistor of the first conductivity type including a first terminal and a control terminal coupled to the first node, and a second terminal coupled to a fifth node, wherein the first diode is coupled in series between the fifth node and the second voltage terminal, and the Zener diode and the second transistor are coupled in series between the fifth node and the second voltage terminal.

4. The circuit of claim 2, wherein the first transistor and the fourth transistor are same in threshold voltage.

5. The circuit of claim 1, wherein a cathode of the first diode is coupled to the second voltage terminal.

6. The circuit of claim 1, wherein an anode of the Zener diode is coupled to the second voltage terminal.

7. The circuit of claim 1, further comprising:

a second diode coupled in series to the first diode.

8. The circuit of claim 1, wherein the first conductivity type is an N-type, and the second conductivity type is a P-type.

9. The circuit of claim 1, wherein an anode of the Zener diode is coupled to the second voltage terminal, a cathode of the Zener diode is coupled to a first terminal of the second transistor, and a second terminal of the second transistor is coupled to the first node.

10. The circuit of claim 1, wherein a second terminal of the third transistor is coupled to the second voltage terminal, a first terminal of the third transistor is coupled to a first terminal of the second resistance, and a second terminal of the second resistance is coupled to the first node.

11. The circuit of claim 1, wherein the first voltage terminal is a power supply voltage terminal, and the second voltage terminal is a ground voltage terminal.

* * * * *